US005944519A

United States Patent [19]

Griffiths

[11] Patent Number: 5,944,519

[45] Date of Patent: Aug. 31, 1999

[54] MOUTH CLEANERS

[76] Inventor: John Stephen Griffiths, 23 Ladyfield Road, Chippenham, Wiltshire SN14 OAN, United Kingdom

[21] Appl. No.: 08/784,655

[22] Filed: Jan. 21, 1997

[30] Foreign Application Priority Data

Jan. 18, 1996 [GB] United Kingdom ..... 9601032
Aug. 16, 1996 [GB] United Kingdom ..... 9617560

[51] Int. Cl.[6] ..... A61G 17/02

[52] U.S. Cl. ..... 433/80; 433/216; 132/329; 15/210.1

[58] Field of Search ..... 132/320, 321, 132/329, 88.7; 433/80, 216; 15/210.1; 401/208, 220; 604/1

[56] References Cited

U.S. PATENT DOCUMENTS

| | | | |
|---|---|---|---|
| 3,863,654 | 2/1975 | Morane et al. | 132/88.7 |
| 4,194,852 | 3/1980 | Cupp et al. | 403/299 |
| 4,527,575 | 7/1985 | Vasas | 132/88.7 |
| 4,767,398 | 8/1988 | Blasius, Jr. | 604/1 |
| 4,856,136 | 8/1989 | Janssen | 15/210.1 |
| 4,922,936 | 5/1990 | Buzzi et al. | 132/321 |
| 5,133,971 | 7/1992 | Copelan et al. . | |
| 5,228,433 | 7/1993 | Rosen . | |
| 5,249,961 | 10/1993 | Hoagland . | |
| 5,337,436 | 8/1994 | Saxer et al. | 15/104.94 |

FOREIGN PATENT DOCUMENTS

| | | |
|---|---|---|
| 0244156 | 11/1987 | European Pat. Off. . |
| 398919 | 9/1933 | United Kingdom . |
| 1573912 | 8/1980 | United Kingdom . |
| 1592513 | 7/1981 | United Kingdom . |
| 2129675 | 5/1984 | United Kingdom . |
| 2130887 | 6/1984 | United Kingdom . |
| 2197203 | 5/1988 | United Kingdom . |
| 2227938 | 8/1990 | United Kingdom . |
| WO 92/04935 | 4/1992 | WIPO . |
| WO 95/31154 | 11/1995 | WIPO . |

OTHER PUBLICATIONS

British Patent Office Search Report, by L.V. Thomas, Examiner, re Application No. GB 9601032.7, dated Jun. 28, 1996; 3 pages.

British Patent Office Search Report, by L.V. Thomas, Examiner, re Application No. GB 9617560.9, dated Sep. 16, 1996; 3 pages plus copy of reference European Patent Application 0,244,156.

*Primary Examiner*—Nicholas D. Lucchesi
*Attorney, Agent, or Firm*—Hudak & Shunk Co., L.P.A.

[57] ABSTRACT

A device for oral cleaning consists of an elongate handle carrying a resilient pad, for example of polyester foam, with flock adhering directly to its surface. Preferably the pad surrounds an underlying support portion of the handle so that this does not contact the interior of the mouth in use. The handle support portion may have a series of projections to enhance the cleaning action. The pad may be pre-impregnated with an oral cleaning agent.

34 Claims, 5 Drawing Sheets

MOUTH CLEANERS

FIELD OF THE INVENTION

This invention relates to devices or instruments for cleaning in the oral cavity, especially the teeth and gums but optionally also other parts of the mouth.

BACKGROUND OF THE INVENTION

Various instruments for cleaning the mouth are well kmown. Toothbrushes are almost universally used, typically with a toothpaste or gel to clean the teeth and that part of the gums immediately adjacent to the teeth.

A satisfactory toothbrush requires a pack of bristles imbedded in a handle and is expensive to make. Known low-cost simplifications include one-piece toothbrushes in which the "bristles" are provided instead as multiple spikes on a moulded plastic head. This is hard and unpleasant to use. Furthermore for people with sensitive mouths, people with mouth ulcers or other lesions or people with missing teeth, even good quality toothbrushes can be unpleasant or painful.

Proposals have been made for non-brush mouth cleaners. For example GB-A-2129675 describes a disposable towelette sheath wrapped around a rubber head on a handle. However the prior proposals have not become popular because they are fussy to use and/or expensive to make. It is hard to reconcile the public's high demands for oral acceptability with a low manufacturing cost.

SUMMARY OF THE INVENTION

A particular aspect herein is the use of a flock directly applied to the surf ace of a pad of resiliently flexible material. My work has shown that, for a variety of reasons, this is a highly and advantageous way of making such a device.

In particular I find that as compared with other methods of creating a pad having a cleaning surface suitable for use in the mouth, techniques using direct flocking onto the pad material can be highly economical to make, require only a few processing steps, give good product reliability and low fluctuation of pad surface quality, and are therefore especially suited to mass production as well as giving a highly satisfactory result for the end user.

The particularly preferred embodiment has the directly-flocked resilient pad carried on a stiff handle, and most preferably a handle provided by a handle element having a support portion which underlies the resilient pad and to which the pad is secured, and an exposed handle or grip portion.

Flocking is in itself a well-known technique. I am not aware of previous proposals for this oral use, but I find that it is highly suitable for the present purposes provided that care is taken to achieve a high-quality flock.

The application of a flock directly to a resilient pad surface obviates the need to provide a separate cover layer and the concomitant difficulties of having to fix the cover layer to the underlying pad sufficiently securely that it follows deformations of the pad without detaching or wrinkling. Compare GB-A-2129675.

Furthermore flocking is a technique very well adapted to mass-production.

Desirably the pad surrounds the handle's support portion; in particular it is preferred that the flocked pad presents a flocked resilient cleaning surface in all directions at the head of the device. This calls for care in the way the resilient pad is mounted on the handle support portion. One method is to form a hole in the resilient pad and insert the handle support portion into the hole. This can be done, and a pad portion with a completely continuous outer cleaning surface in all directions thereby achieved. The surface may be flocked before or (preferably) after fitting of the handle in this version.

From the processing and manufacture point of view it may be simpler to apply the pad to the support portion of a handle by bending, folding or wrapping a piece of pad material about the handle support portion, or by applying first and second portions of pad material from opposite sides of the handle support portion. To avoid exposure of the handle support portion through gaps between such parts or pieces resilient pad, I prefer to arrange the fixing of the pad material onto the handle support portion so that resilient pad portions which are opposed to one another where they project beyond the handle portion meet one another and thereby cover that potentially exposed part of the handle. They may be glued together but this is not preferred because the presence of glue between the pad portions sometimes gives an uncomfortable feel of non-uniformity in use. I prefer to arrange the relative shapes of the handle portion and pad portions such that when those parts of the pad portions overlying the handle portion are fixed to it, the opposed parts projecting beyond it are pressed together against their own resilience. This may be by shaping the resilient pads with enlargement of those portions or, more conveniently, by shaping the surface of the handle support portion to have convergent securing faces on opposite sides so that pad portions adhered to those respective faces and projecting beyond them will meet at the projecting parts.

Preferred pad arrangements include a single block of pad material penetrated by a handle insertion opening as proposed above, and a construction in which two opposed portions of pad material are secured to opposite faces of a handle support portion; the two opposed portions may conveniently be respective halves of a single folded piece.

Preferably the pad material is secured to the handle support portion by adhesive. The handle support portion may have one or more lateral projections to help prevent inadvertent detachments of the pad portion. It may also be possible to retain the pad on the handle merely by the use of lateral projections on the handle portion i.e. without using adhesive. This is particularly so when the handle portion is inserted into an opening made in a single piece of pad material.

It is also possible to provide a series of lateral projections or undulations on the handle support portion, underlying the pad material, to enhance the cleaning effect of the device by varying the local pressure through the pad as it is rubbed across the point of contact. Such undulations or projections may of course also have the effect of helping to retain the pad on the handle.

Additionally or alternatively the surface of the pad material itself may have a series of undulations, ribs or other projections for the same reason. When the pad has a firmer resilient material underlying a softer material (see later) such undulations etc. may be provided at least in the surface of the firmer material.

As regards flock materials, any material suitable for hygienic oral use may be used. These will of course usually be polymeric fibres and in particular I find that nylon and rayon are suitable. Suitable flock fibre lengths are most preferably between 0.2 and 1.5 mm, more preferably between 0.3 and 1 mm. Preferred linear fibre densities are between 0.5 and 5 dtex, more preferably 1 to 3 dtex.

Viscose rayon is one suitable fibre material; experimenting with this I found that the preferred fibre was 0.5 mm, 1.7 dtex.

Experimenting with nylon fibres I found that again 1.7 dtex fibres were preferable (although these were less soft than the rayon fibres) and fibre lengths from 0.5 to 1 mm were particularly good.

As regards the resilient pad material, I prefer synthetic foam. Any suitable material may be selected provided that it is suitable for oral use and susceptible to flocking. I prefer polyester foams. Open-cell foams should be selected to have a cell size sufficiently small to give a satisfactory flock finish. Large open-cell foams give less preferable results because the flock adhesive used for flocking tends to sit in the foam surface cells and be present unevenly, on the scale of the flocking operation. The resultant flock surface tends to give a slightly rough look and feel, while the unevenness of the adhesive leads to a greater tendency for a minority of flock fibres to be inadequately adhered and liable to come loose in use.

I find that a small-cell foam gives much better and much more reliable results, with very few tree fibres remaining after the flocking process and a cleaning surface with excellent look and feel.

Open-cell foams are of course susceptible to wetting throughout. This is satisfactory if the device is to be used without first wetting it, as might be the case e.g. for a travel accessory. It is also useful it the pad in to be pre-treated with a mouth cleaning aid such as a toothpaste or mouth freshener.

In some situations however full wetting may not be desirable since it can be detract from the resilience of the pad and consequently from its cleaning effect. A useful option therefore is to 'close' all or part of the pad material against wetting. This can be done using a relatively impermeable material, e.g. a closed-cell foam, or an open-cell foam rendered impermeable at its surface by the formation of a surface skin (this is a well-known product) for all or part of the pad. A closed surface is also advantageous in that it is easier to form a fully-adherent flock.

One useful compromise uses an outer open-cell layer on an inner closed-cell (or skinned open-cell) layer or core: this allows partial wetting (useful e.g. for impregnation with cleaning aid) but not full wetting.

Additionally or alternatively there may be a core of firmer material and an outer layer of softer material.

Suitable laminations of different foam materials can readily be prepared for mass-production.

The selection of the specific appropriate foam material(s) is of course a reasonably routine matter for the skilled person, but I indicate here the functional requirements which must be borne in mind when making the selection.

One particular criterion is that the flock finish should be suitable for oral use, and this means that substantially none of the flock fibres should come free when the device is used for oral cleaning. In addition to selecting a suitable pad material, therefore, care should also be taken to apply a high-quality flock finish. These skills are routinely available in the flocking art.

One preferred method for improving the quality of flock finish is to shape the pad's cleaning surface so that it does not present any sharp edges. Edges on the cleaning surface are preferably at least rounded off and most preferably the entire cleaning surface is convexly curved. Most preferably the pad material at the time of flocking presents a cleaning surface which is all directed at least partially in a single direction, so that effective flocking of the entire surface can be done in a single direction for a single orientation of the pad substrate. The reverse, unflocked surface of the substrate can then be used for securing to the handle support portion.

Use of this technique makes the flocking operation more efficient, from the point of view of avoiding the need to adjust the flock direction/substrate orientation, and also more effective in that by avoiding concentration of the flock along edges (which tends to occur then edges are present, because of electrostatic effects) the resultant flock quality is better and the proportion of free fibres lower.

The shape and material of the handle may be chosen according to preference. I prefer a stiff plastics handle. This can be made of food-grade plastic, for example polystyrene. I also prefer a generally linear handle, with an in-line continuation forming the support portion on which the pad material is fixed. The support may be e.g. in a strip or rod form according to the fixing technique.

The dimensions of the resilient pad and handle portions can be determined for suitability in oral use. Particular criteria include sufficient thickness to provide resilience adequate for cleaning and sufficient length to allow a controlled rubbing action, but dimensions sufficiently small to permit easy insertion into the mouth (taking account of whether it is intended for use by adults or children).

Specifically, thickness of pad material overlying the handle's support portion is usually at least 5 mm, preferably at least 6 mm and more preferably at least 7 or 8 mm. Usually it is not more than 14 mm and preferably not more than 12 mm. This thickness prevails in at least one direction transverse to the support portion, and more preferably at least in two opposed such directions. As to length of the pad, it is usually at least 15 mm, preferably at least 20 mm. 50 mm would usually be an effective maximum length with less than 40 mm being preferred.

Width is less important (subject of course to the preference for covering or surrounding the handle's support portion). Usually it would be at least 5 mm, preferably at least 7 or 8 mm. It would not normally be more than 20 mm, preferably not more than 15 or 16 mm.

The support portion and corresponding pad may be substantially axially linear, but this is not necessarily so. In particular the whole support portion may be arcuate, or an end portion may have a backwardly-curved part to facilitate clearing the inside surfaces of teeth.

Preferably the support portion underlies at least 60%, more preferably at least 70% of the length of the pad.

Another general aspect of the invention is the use of a cleaner as described herein for cleaning the teeth, e.g. for cosmetic purposes.

BRIEF DESCRIPTION OF THE DRAWINGS

The above proposals are now illustrated with reference to the accompanying drawings, in which FIGS. 1, 1 (*a*), 1 (*b*), 1 (*c*), and 1 (*d*) show various shapes of foam block and indicates the application of adhesive thereto.

DETAILED DESCRIPTION OF PREFERRED EMBODIMENTS

Figure 1:
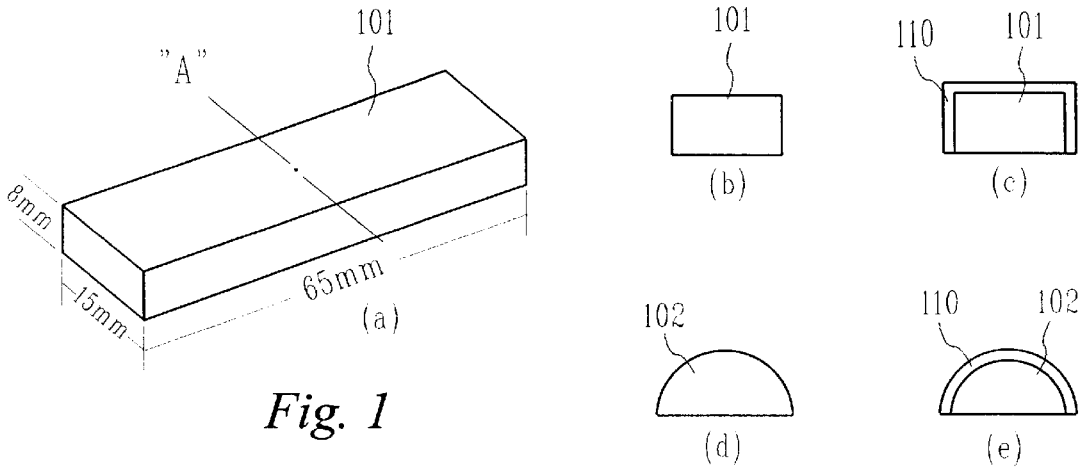
Figure 2A:
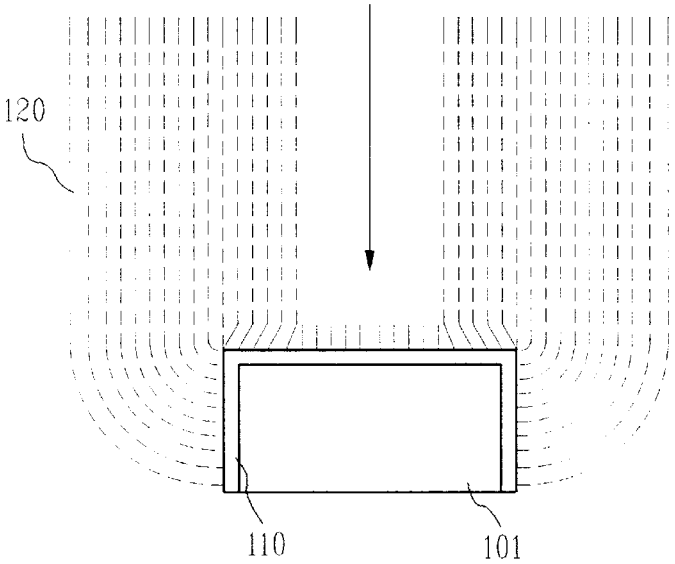
FIG. 2 (*a*) (*b*) shows the effects of flocking on different surface shapes of foam block.
Figure 2B:
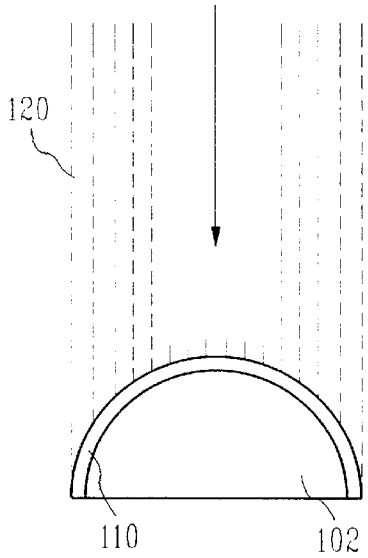
Figure 3A:
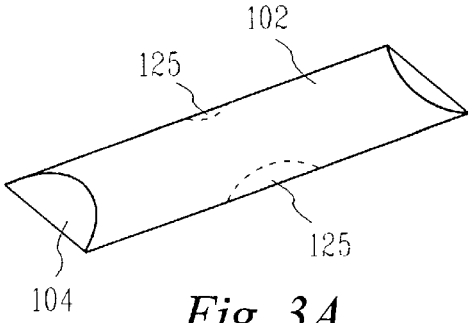
FIG. 3 (*a*, (*b*) shows the contact surface shape of a preferred foam unit, in perspective and side views.
Figure 3A:
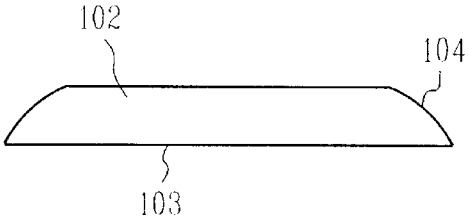

FIGS. 1 to 3 illustrate selection of a foam pad surface most suitable for creating a useful flocked cleaner. FIG. 1 shows a single elongate rectangular strip 101 of polyester foam material; FIGS. 1(*a*) and (*b*) show it in section at "A" and with a layer of flocking adhesive 110 applied over three of its long surfaces. The other surface is for use in attachment to the handle. FIGS. 1 (*c*), (*d*) show the same section for a preferred foam strip whose upper surface presents a single convex curve, with an upward-facing component over essentially all of its surface. As seen in FIGS. 2 A,B, the rectangular-section strip 101 suffers from difficulties during flocking. Flocking is done by means of attracting flocking fibres 120 onto the flocking adhesive 110 using an electrostatic field. At the sides of the rectangular-section strip 101 the sideways-facing surfaces are inadequately flocked while the edges attach an unduly large proportion of flock which then tends to be inadequately fixed. The resulting flocked pad consequently has an uneven finish and a tendency to shed flock fibres.

By contrast the upwardly convex or crescent-section strip 102 achieved a generally even flocking over the entire upward surface, as seen in FIG. 2B.

To check the adequacy of the flocking I used a simple test in which the flock was first rubbed vigorously with a wet finger for 30 seconds and then examined under a microscope for the presence of free flock fibres. The FIG. 2(*a*) version revealed substantial numbers of free fibres at the edges, while the FIG. 2(*b*) version showed no: free fibres at all.

FIG. 3 shows the crescent-section strip 102 from different angles. Its end surfaces 104 are also chamfered over so that they too will be flocked from that same flocking direction. The undersurface 103 is of course not flocked, because this is used for attachment to the handle. It is preferred to reduce the thickness at central edge regions 125.

Figure 4:
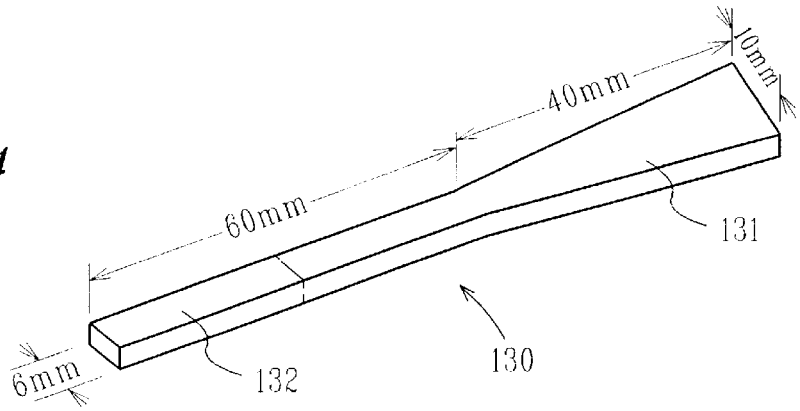
FIG. 4 shows a general shape of handle element.

FIGS. 4 to 11 concern the handle and means of attaching to it. FIG. 4 shows a first version of handle 130, which is a simple strip of food-grade polystyrene the same as used for making plastic cutlery. The handle element 130 presents a handle portion 131, here having a broadened part to improve grip, and a support portion 132 at the opposite end to which the pad 102 is to be attached.

Figure 5:
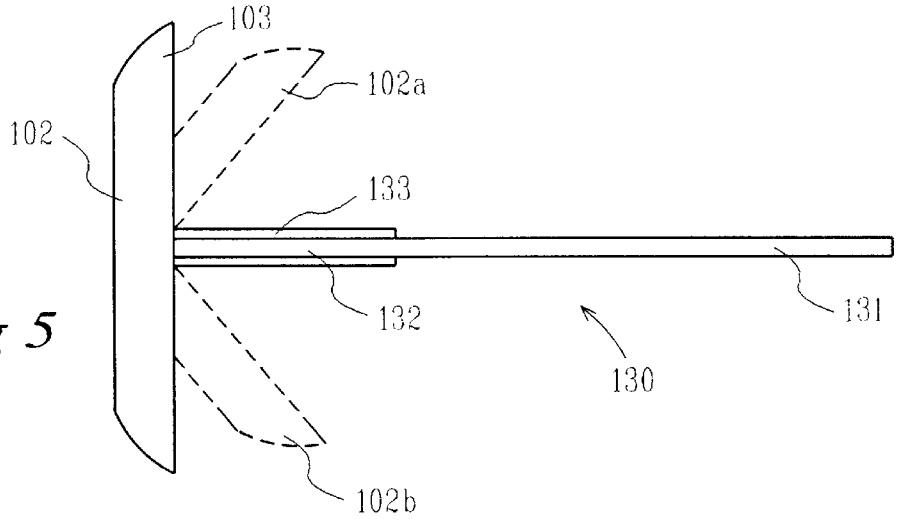
FIG. 5 shows folding a foam unit onto the handle element.

FIG. 5 shows how an adhesive layer 133 is applied to both faces of the handle support portion 132, and the flocked foam strip 102 folded around the end of the handle portion 132 so that its unflocked securing surface 103 is brought against the adhesion surfaces 133 of the handle portion and secured there. Thus a top portion 102*a* of the strip covers the top of the handle, a bottom portion 102*b* covers the bottom of the handle while an intermediate portion 102*c* wraps around to cover the end of the handle. The preferred recessing at regions 125 avoids bulging of the edges at the sides of the end fold.

Figure 6A:
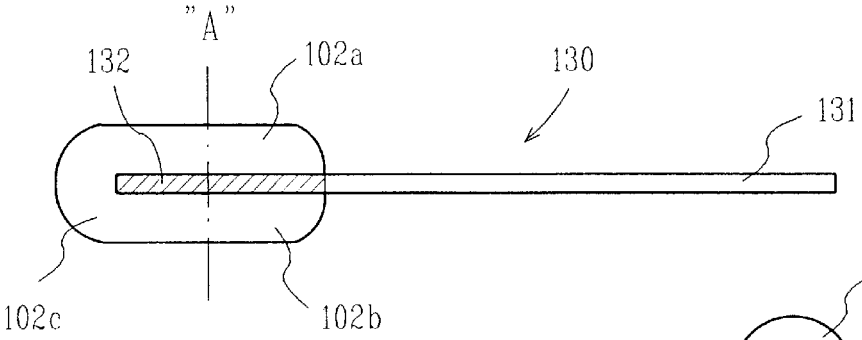
FIGS. 6(*a*) and 6(*b*) show a basic form of the completed device.
Figure 6B:
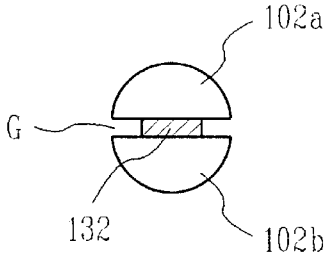

The simple technique described does not always achieve total coverage of the handle. Total coverage is preferred in order to avoid any possibility of inadvertent contact of stiff plastic with the interior of the mouth. FIG. 6(*b*) shows (exaggeratedly) how gaps G may still be present between the opposed surfaces of the two pad portions 102*a,b* where they project sideways beyond the handle portion 132.

Figure 7:
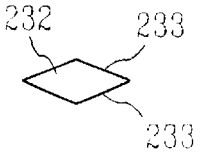
FIGS. 7 (*a*) (*b*), (*c*) and 8 show assembly stages and final form of a refinement of the foam pad securement.
Figure 7A:
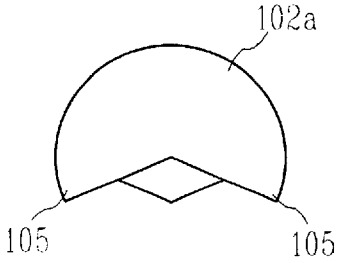
Figure 7B:
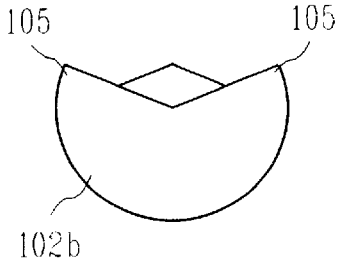
Figure 8:
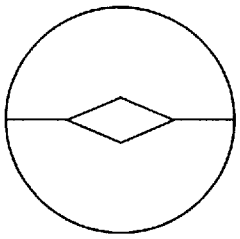

FIGS. 7 and 8 show how this may be conveniently avoided by shaping the handle portion differently. The preferred handle portion 232 has convergent adhesion faces 233 on its opposite faces towards the side edges. When a flat-bottomed foam strip 102 is stuck onto this, its side edge portions 105 are deformed downwardly and project down beyond the median plane. Special shaping of the foam strip 102 is not needed. FIG. 7(*b*) shows the corresponding adhered conformation for the lower pad portion 102*b*. When both are adhered, as shown in FIG. 8, the projecting portions 105 are pushed against one another and resiliently compressed, ensuring a complete surround of the handle portion 232 without the need to provide adhesive between the pad edges 105.

In the finished cleaner, exemplary dimensions of the pad portion are:

for an adult, 10 mm thickness on either face of the handle strip, 35 mm length and 15 mm width;

for a child, 7, 20 and 8 mm for the corresponding dimensions.

Figure 9:
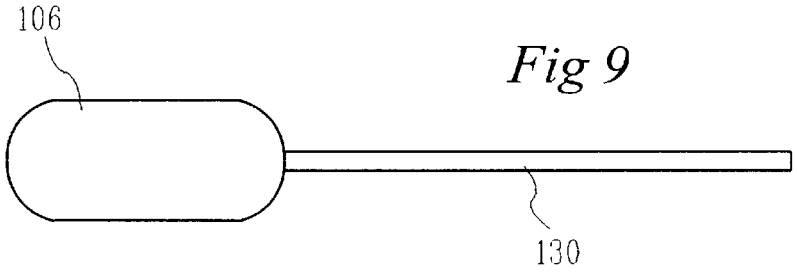
FIG. 9 shows a second version of the device.
Figure 10A:
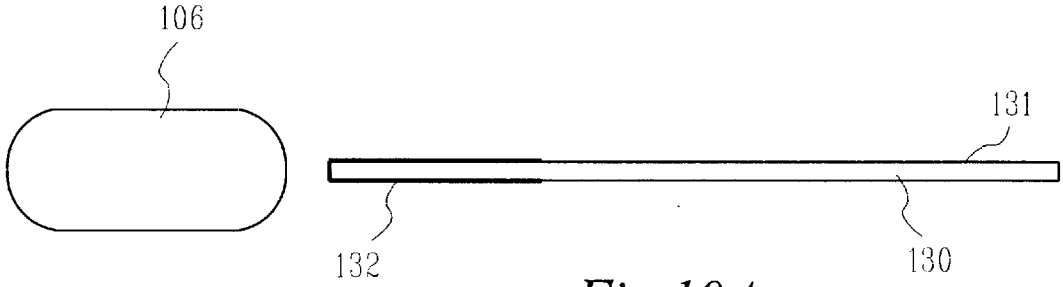
FIG. 10 (*a*), (*b*), (*c*) shows stages in manufacture of the FIG. 9 version.
Figure 10B:
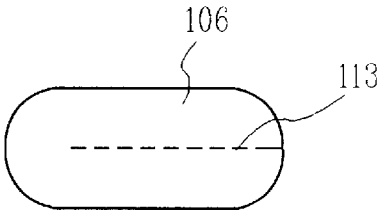
Figure 10C:
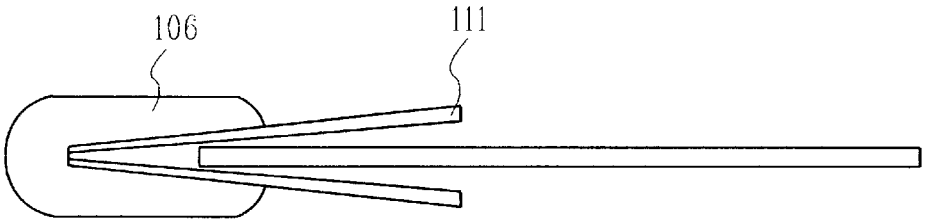
Figure 11:
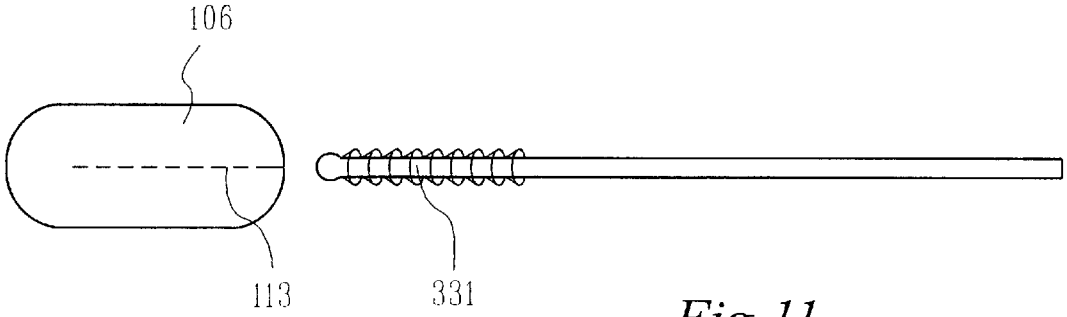
FIG. 11 shows a variant of the FIG. 9 version.

FIGS. 9, 10 show an alternative securing arrangement in which a single piece of pad material 106 is not folded but rather provided with a long narrow hole or slit 113 along its mid-line. The adhesive-treated support portion 132 of a handle 130 is then pushed into the hole 113, optionally using a tool 111 to separate the hole walls during insertion and keep the adhesive in the right place. The hole 113 is of course preferably undersized for the handle portion 132. FIG. 11 shows how the handle portion may be provided with one or more lateral projections, e.g. a series of annular ribs 331 as shown in the drawing, to achieve mechanical security for the fixing. Taking into account the relatively small forces occurring in use, such a mechanical interlock may entirely replace the use of adhesive if preferred. FIG. 9 shows the end product in either case.

Figure 12:
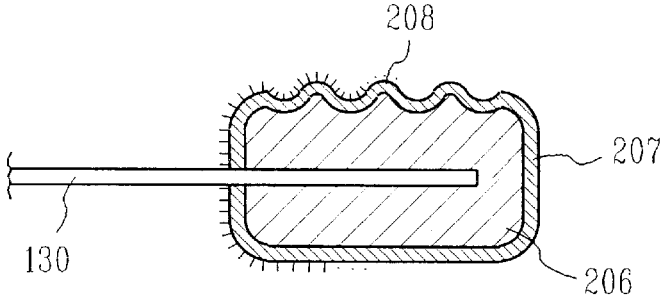
FIG. 12 illustrates the cleaning head of a third version of cleaner.

FIG. 12 shows a third embodiment illustrating other possibilities. The previous embodiments were made using a single piece of one kind of foam material, specifically small-cell open-cell foam. Open-cell foam is good for single-use applications without extra water, but may become soggy and lose resilience if too much water is present. One answer to this is to use closed-cell foam or open-cell foam having a closed surface. The constructions of the previous embodiments can be made with such foams.

It is also possible, as FIG. 12 shows, to use more than one kind of resiliently flexible material. An outer resilient layer 207 is adhesively laminated onto a inner resilient layer or core 206. The flock is applied on the outer layer 207. Laminated foams of this kind can be prepared using routine knowledge in the field of foamed plastics.

In one aspect the inner material 206 is firmer and harder than the outer material 207 which is softer. This gives a sympathetic surface but with higher backing firmness for more effective cleaning.

Another aspect relates to water absorption. The core 206 may be of closed-cell foam, open-cell foam with a closed surface skin or some other non-absorptive resilient material so that it does not become soggy in use. The outer layer 207 can be of open-cell foam which is therefore wettable and this may give useful properties. For example it may be desirable for the device to hold more water than would be retained by the flock alone, but without becoming entirely saturated. Some open cells are also advantageous if the device is to be pre-treated with a cleaning aid such as a toothpaste.

Another possibility is for the inner layer to be open-cell foam and the outer layer 207 to be closed-cell or other impermeable material to prevent wetting of the core.

FIG. 12 also illustrates the provision of a series of undulations 208 in the surface of the resilient pad. These can enhance the cleaning effect. They may be provided on only part of the pad surface, e.g. on one side as shown. The illustrated embodiment has the undulations in both core and surface layer, but where the core is firmer they may be provided in the core only. Of course, corresponding undulations may be provided in a pad made of only one material.

Figure 13:
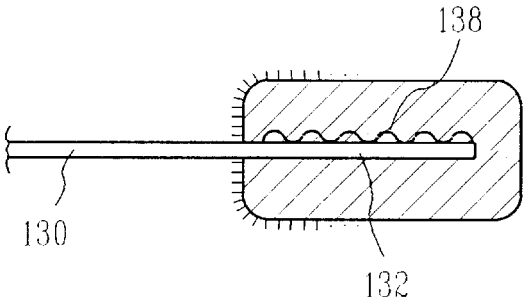
FIGS. 13 and 14 show fourth and fifth embodiments.

FIG. 13 shows an alternative or additional possibility in which a series 138 of projections in the form of lumps or ridges is provided on the hard surface of the handle support portion 132. These may be moulded integrally with the handle, or stuck on subsequently as an applique. They enhance the cleaning effect through the softer resilient material when the latter is compressed against the teeth. They may of course be used in conjunction with undulations of the pad as shown in FIG. 12. They may be only on one side, as shown.

Figure 14:
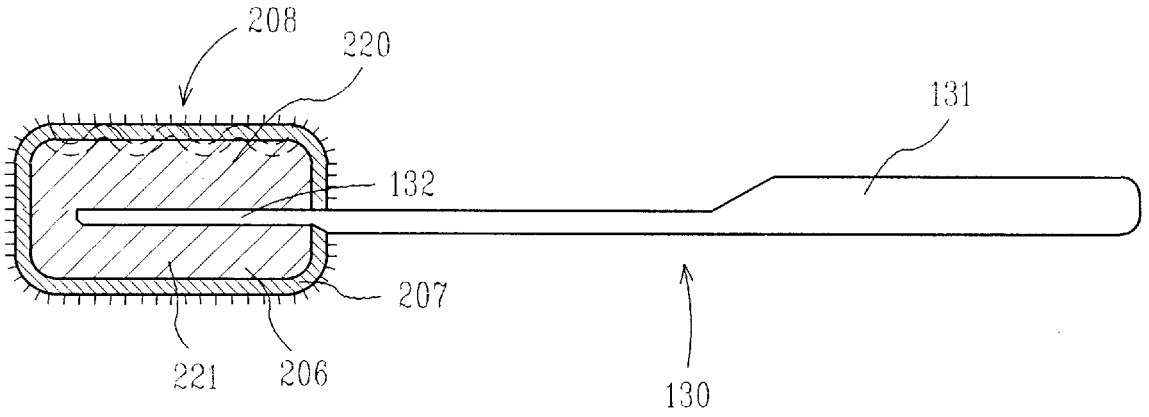

FIG. 14 shows a version in which the handle 130 is in the same style as a toothbrush handle, with a fully stiff grip portion 131 which may extend up to 180 mm from the juncture with the cleaning end. Another feature here is the application of the resilient pad with a larger thickness 220 on one side of the handle support portion 132 than on the other side 221. This gives different cleaning effects on the two sides at the option of the user. The pad in this embodiment is of the two-layer 206, 207 construction with the option of surface corrugations 208 shown in broken lines.

The pad may be flocked after fitting to the handle.

To prepare the flocked cleaning surface for eventual use it is preferably subject to suction cleaning to remove loose or insufficiently-adhered flock fibres. It may also be washed (e.g. to sterility) and dried before packaging.

For the avoidance of doubt, I mention that the devices described here may complement as well as replace the use of a toothbrush. In particular, the present device can achieve a polishing effect not available from a toothbrush.

I claim:

1. An oral cleaner for human use, comprising;

an elongate handle element including a grip portion and a support portion and a resilient pad attached to and overlying the handle support portion, the resilient pad being from about 15 to 50 mm long and from about 5 to 20 mm wide and having a flocked outer cleaning surface provided by flocking on the surface of the resilient pad, said flocking being of flock fibres from about 0.2 to about 1.5 mm long.

2. An oral cleaner according to claim 1 in which the resilient pad is of cellular material.

3. An oral cleaner according to claim 2 in which the cellular material is closed-cell polymeric foam.

4. An oral cleaner according to claim 2 in which the cellular material is open-cell polymeric foam.

5. An oral cleaner according to claim 4 in which the open-cell foam has a closed surface.

6. An oral cleaner according to claim 2 in which the resilient pad comprises an outer layer of softer foam on a core of firmer foam.

7. An oral cleaner according to claim 1 in which the length of the resilient pad is at least 20 mm.

8. An oral cleaner according to claim 1 in which the thickness of the resilient pad overlying the handle support portion is at least 5 mm.

9. An oral cleaner according to claim 1 in which the width of the resilient pad is in the range 7 to 16 mm.

10. An oral cleaner according to claim 1 in which the resilient pad surrounds the handle support portion.

11. An oral cleaner according to claim 1 in which the resilient pad is a single piece of resilient pad material bent around the handle support portion.

12. An oral cleaner according to claim 1 in which the handle support portion is in the form of a strip.

13. An oral cleaner according to claim 1 in which the handle support portion is formed as a one-piece integral unit with the handle grip portion.

14. An oral cleaner according to claim 1 in which the handle support portion has a longitudinal series of projections underlying the resilient pad.

15. An oral cleaner according to claim 1 in which the cleaning surface of the resilient pad has a series of undulations.

16. An oral cleaner according to claim 1 in which said flock fibres are between about 0.3 and about 1 mm in length and between about 1 and 3 dtex.

17. An oral cleaner, comprising;

an elongate handle element including a grip portion and a support portion, and a resilient pad attached to and overlying the handle support portion and having a flocked cleaning surface provided by flocking on the surface of the resilient pad, said resilient pad having an impregnation of an oral cleaning agent.

18. An oral cleaner according to claim 17, in which the resilient pad is from about 15 to 50 mm long and from about 5 to 20 mm wide.

19. An oral cleaner according to claim 18, in which said flocking is of flock fibres from about 0.2 to about 1.5 mm long.

20. An oral cleaner for human use comprising;

an elongate handle element including a grip portion and a support portion, and a resilient pad attached to and overlying the handle support portion, the resilient pad being from about 15 to about 50 mm long and surrounding the support portion of the handle element, the resilient pad further having a flocked outer cleaning surface provided by flocking on the surface of the resilient pad.

21. An oral cleaner according to claim 20, in which said flocking is of flock fibres from about 0.2 to about 1.5 mm long.

22. An oral cleaner according to claim 21, in which said flock fibres are from about 0.3 to about 1 mm long and between about 1 and about 3 dtex.

23. An oral cleaner according to claim 21, in which the resilient pad presents said flocked outer cleaning surface all around the support portion of the handle element.

24. An oral cleaner according to claim 21, in which the resilient pad comprises first and second portions of pad material applied to opposite sides of the support portion.

25. An oral cleaner according to claim 20, in which the handle support portion is inserted in a hole in the resilient pad.

26. An oral cleaner according to claim 20, in which the handle support portion comprises a series of projections underlying the resilient pad.

27. An oral cleaner according to claim 20, having an impregnation of an oral cleaning agent.

28. An oral cleaner according to claim 20, in which the thickness of said resilient pad overlying the support portion of the handle element is at least about 5 mm in at least two opposed directions transverse to the support portion.

29. An oral cleaner according to claim 20, in which the resilient pad is up to about 20 mm wide.

30. An oral cleaner according to claim 29, in which the resilient pad is up to about 16 mm wide.

31. An oral cleaner for human use, comprising:

s stiff handle support portion;

a resilient pad attached to and overlying said handle support portion to a depth of at least about 5 mm, said resilient pad being of cellular material selected from the group consisting of closed-cell polymeric foam and open-cell polymeric foam with a closed surface, and having a flocked outer cleaning surface provided by a flocking of flock fibres between about 0.3 and about 1 mm in length, said pad being suitable for use with an oral cleaning agent.

32. An oral cleaner for human use, comprising:

a resilient pad and a support portion, the resilient pad being attached to and overlying the handle support portion, the resilient pad being from about 15 to about 50 mm long, from about 5 to about 20 mm wide, at least about 5 mm thick, and having a flocked outer cleaning surface provided by flocking on the surface of the resilient pad, said flocking being of flock fibres from about 0.2 to about 1.5 mm long.

33. An oral cleaner according to claim 32, in which said flock fibres are between about 0.3 and about 1 mm in length and between about 1 and about 3 dtex.

34. An oral cleaner according to claim 32, having an impregnation of an oral cleaning agent.

* * * * *